US006123625A

United States Patent [19]

Koblentz

[11] Patent Number: 6,123,625

[45] **Date of Patent: *Sep. 26, 2000**

[54] GRIP FOR GOLF PUTTER

[76] Inventor: Thierry Koblentz, 32 Porto Bello, San Rafael, Calif. 94901

[ * ] Notice: This patent issued on a continued prosecution application filed under 37 CFR 1.53(d), and is subject to the twenty year patent term provisions of 35 U.S.C. 154(a)(2).

[21] Appl. No.: 09/018,280

[22] Filed: Feb. 4, 1998

[51] Int. Cl.[7] ..... A63B 53/14

[52] U.S. Cl. ..... 473/203; 473/300; 473/409

[58] Field of Search ..... 473/300, 301, 473/302, 303, 298, 558, 559, 562, 294, 568, 549, 538, 203

[56] References Cited

U.S. PATENT DOCUMENTS 3,459,426 8/1969 Sherwood .
4,067,573 1/1978 Key .
4,215,860 8/1980 Nakamatsu .
4,374,589 2/1983 Strickland .
4,537,403 8/1985 Farina .
5,588,921 12/1996 Parsick .
5,645,493 7/1997 Garcia .
5,779,559 7/1998 Eberle .
5,795,241 8/1998 Peshek .

*Primary Examiner*—Sebastiano Passaniti
*Attorney, Agent, or Firm*—Townsend and Townsend and Crew LLP

[57] ABSTRACT

A grip for a golf putter that includes a shaft defining a longitudinal axis and a putter head having a putter face. The grip comprises an elongated body that extends along a major axis corresponding to the longitudinal axis defined by the shaft. The body has a front side and an opposing back side. The front side and the back side are substantially flat and define an elongated cross-section that extends along a transverse axis that is substantially perpendicular to the longitudinal axis and transverse to the club face.

10 Claims, 9 Drawing Sheets

GRIP FOR GOLF PUTTER

BACKGROUND OF THE INVENTION

1. Field of the Invention

The present invention relates to a grip for a golf club, and more particularly, to a grip for a golf putter.

2. Description of the Prior Art

The art of golf putters has been extremely well-developed since the game was first developed centuries ago. Various materials have been used for golf club shafts, ranging from hickory and willow to metals and space age technology graphite reinforced resin composites. At the present time, most golf club shafts are made of steel that is then chrome plated and a rubber or composition grip is then glued to the shaft. Steel shafts are usually continuously tapered or step-tapered from a thin tip end to the handle or butt end and are designed with flexibility characteristics for wood or iron head clubs intended to be swung for full or partial shots rather than for putters. These same steel shafts are then cut down to a length appropriate for putter shafts.

Ingenuous golf putter developments in the past have resulted in various configurations, including those having single and double bend steel shafts; straight steel shafts with or without fluting over a portion of their length; and straight shafts made of other materials, such as fiberglass or graphite composites and alloys. Apart from special bends or fluting, most shafts used in prior art putters are ordinary steel shafts not specially constructed for putter use. The butt or handle ends of these shafts generally have a circular cross-section having a typical diameter in the range of from 0.580–0.600 inches for receiving a grip of rubber or leather or other non-slip, generally soft material. The exterior grip configuration may vary within the Official Rules Of Golf. However, it is generally most desirable to have a grip configuration that complies with the dimensions outlined by the Official Rules Of Golf as promulgated by the Royal and Ancient Golf Club of St. Andrews and the United States Golf Association (hereinafter "R & A standards and rules"). A copy of the Rules Of Golf For Design Of Clubs is attached as Appendix A.

In direct contrast with golf club shafts intended for woods and irons, where achieving maximum distance is one of the major objectives accomplished by cocking of the wrists on the back swing and uncorking or release of the wrists on the down swing to generate high club head speed, putters should have stiff shafts and the golfer's wrists preferably should not break when executing a putting stroke. A good putting stroke is quite the opposite in that it is accepted wisdom in teaching circles that the golfer should not cock or break his wrists during the putting stroke. Instead, the triangle formed by a golfer's shoulders and arms is generally kept in a constant configuration to control speed and direction of the putt. This suggests that the ideal putter should have characteristics that assist the golfer in keeping his wrists stiff or firmly locked when putting. Accordingly, the handle should be configured (preferably in conformity with R & A standards and rules) to assist the golfer in keeping his wrists firm during the putting stroke.

"Letting the club do the work" doesn't apply to putting. Since centrifugal force has little relevance in a putter's stroke, in comparison to other golf shots, it is particularly difficult for the golfer to keep the putter club head square on the correct path to the hole for the entire swing of the club. If the golfer has any doubt about the trajectory of the club head, he will try to correct the path or the angle of the club head during the stroke. This doubt is natural since it is the result of visual bearings that are frequently contradictory in the golfer's mind to the location of the hole. Accordingly, negative side effects will be produced by the fingers, the hands, the wrists, or by any other part of the body when the golfer attempts to address his concerns about the trajectory of the club head. Thus, a pendulum stroke is widely accepted as being the best way to strike a ball on the putting green.

SUMMARY OF THE INVENTION

A grip for a golf club in accordance with the present invention addresses the shortcomings of the prior art.

In accordance with the present invention, a grip for a club that includes a shaft defining a longitudinal axis and a club head having a club face comprises an elongated body that extends along a major axis corresponding to the longitudinal axis defined by the shaft. The body has a front side, an opposing back side, a right portion and a left portion. The front side and the back side are substantially flat at the right portion and at the left portion. The body defines an elongated cross-section that extends along a transverse axis that is substantially perpendicular to the longitudinal axis and transverse to the club face.

In accordance with one aspect of the present invention, the grip further comprises a recess for receiving the shaft to thereby connect the grip to the shaft.

In accordance with another aspect of the present invention, the recess extends substantially throughout the body between the right portion and the left portion.

In accordance with another aspect of the present invention, the grip is integral with the shaft.

In accordance with yet another aspect of the present invention, the grip includes rounded edges.

In accordance with a further aspect of the present invention, the grip includes sharp edges.

In accordance with yet another aspect of the present invention, the grip has dimensions that comply with R & A standards and rules for putter grips.

In accordance with a further embodiment of the present invention, a club comprises a shaft defining a longitudinal axis, a club head having a club face and being connected to a distal end of the shaft, and a grip connected to a proximal end of the shaft. The grip comprises an elongated body that extends along a major axis corresponding to the longitudinal axis defined by the shaft. The body has a front side and an opposing back side. The front side and the back side are substantially flat and define an elongated cross-section that extends along a transverse axis that is substantially perpendicular to the longitudinal axis and transverse to the club face.

In accordance with one aspect of the present invention, the club is a golf putter and the grip has dimensions that comply with R & A standards and rules for putter grips.

In accordance with one aspect of the present invention, a method of gripping a club grip comprises providing a club having a grip, placing thumbs of a user adjacent one another on a front surface of the grip, and curling at least one finger of a right hand of the user adjacent at least one finger of the left hand of the user along a back surface of the grip.

Accordingly, the present invention provides a grip for a golf putter having that allows a golfer to minimize putter jerks and "yipes" and promotes a better pendulum stroke for more accuracy.

Other features and advantages of the present invention will be understood upon reading and understanding the detailed description of the preferred exemplary embodiments, found hereinbelow, in conjunction with reference to the drawings, in which like numerals represent like elements.

DETAILED DESCRIPTION OF THE PREFERRED EXEMPLARY EMBODIMENTS

While the present invention is generally intended for use with golf putters, and for simplicity and clarity will be described herein as such, it is to be understood that such a grip may have use, for various purposes, with other golf clubs and similar items, such as mallets for croquet and other similar games. Thus, the term club as used herein includes golf clubs, golf putters, mallets and the like.

Figure 1A:
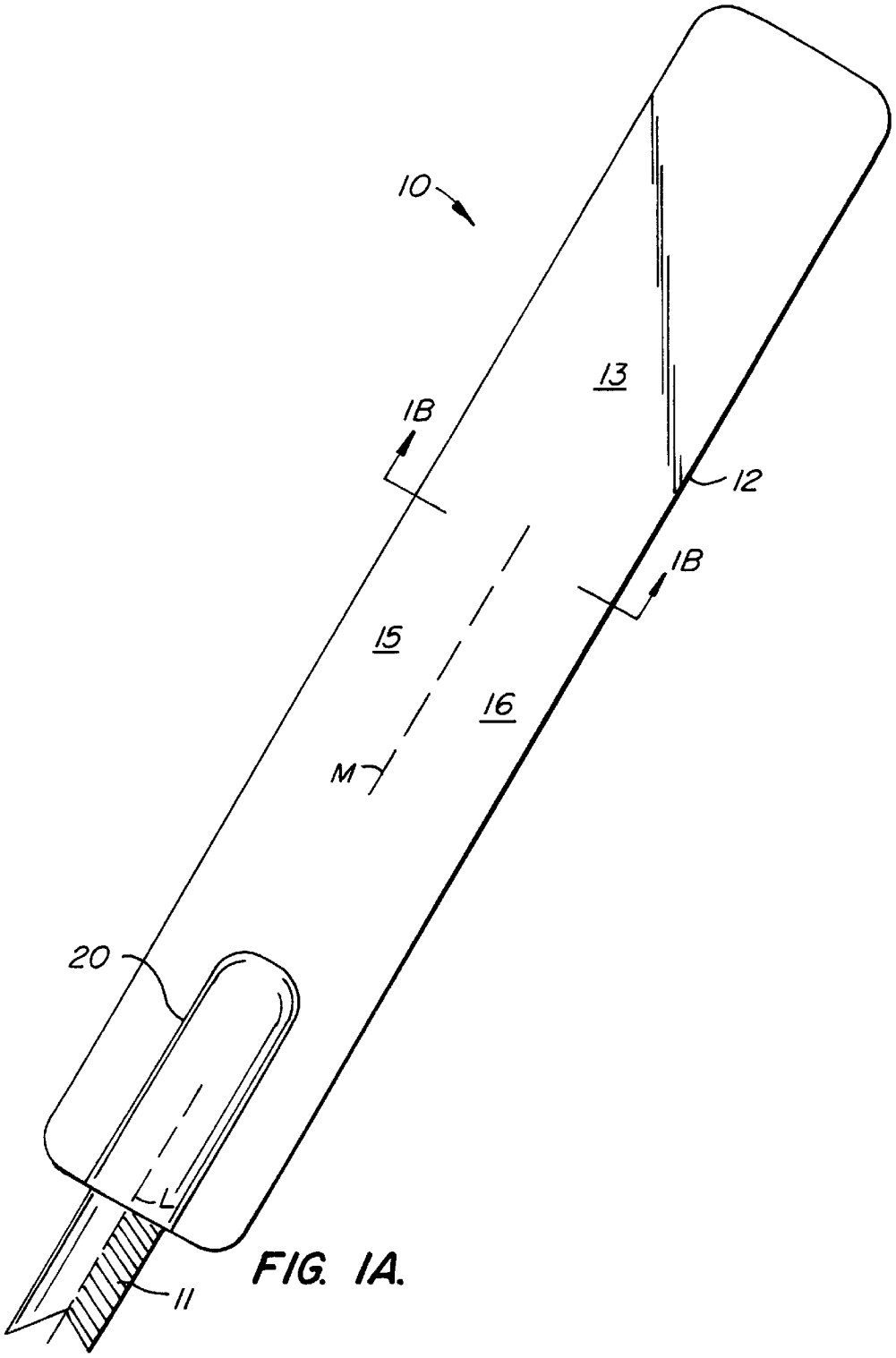
FIG. 1A is a plan view of a grip in accordance with the present invention.

Turning to FIG. 1A, a grip 10 is illustrated. The grip is connected to a shaft 11 of a club. Shaft 11 defines a longitudinal axis indicated by dashed line L. Grip 10 comprises an elongated body 12 that extends along a major axis, represented by dashed line M, corresponding substantially to the longitudinal axis L. Body 12 includes a front side 13, an opposing back side 14, a right portion 15 and a left portion 16.

Figure 1B:
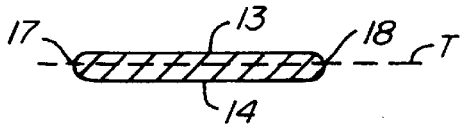
FIG. 1B is a cross-sectional view of a grip in accordance with the present invention.

As can be seen in FIG. 1B, front side 13 and back side 14 are substantially flat. Body 12 defines an elongated cross-section that extends along a transverse axis T. As can be seen in FIG. 1B, body 12 preferably includes rounded edges 17, 18. This provides for greater comfort for the golfer's hands when gripping grip 10. Obviously, body 12 could have "sharp" edges such that the cross-section of the body would have a substantially rectangular cross-section. Such a configuration may improve a golfer's grip when gripping grip 10.

Figure 6A:
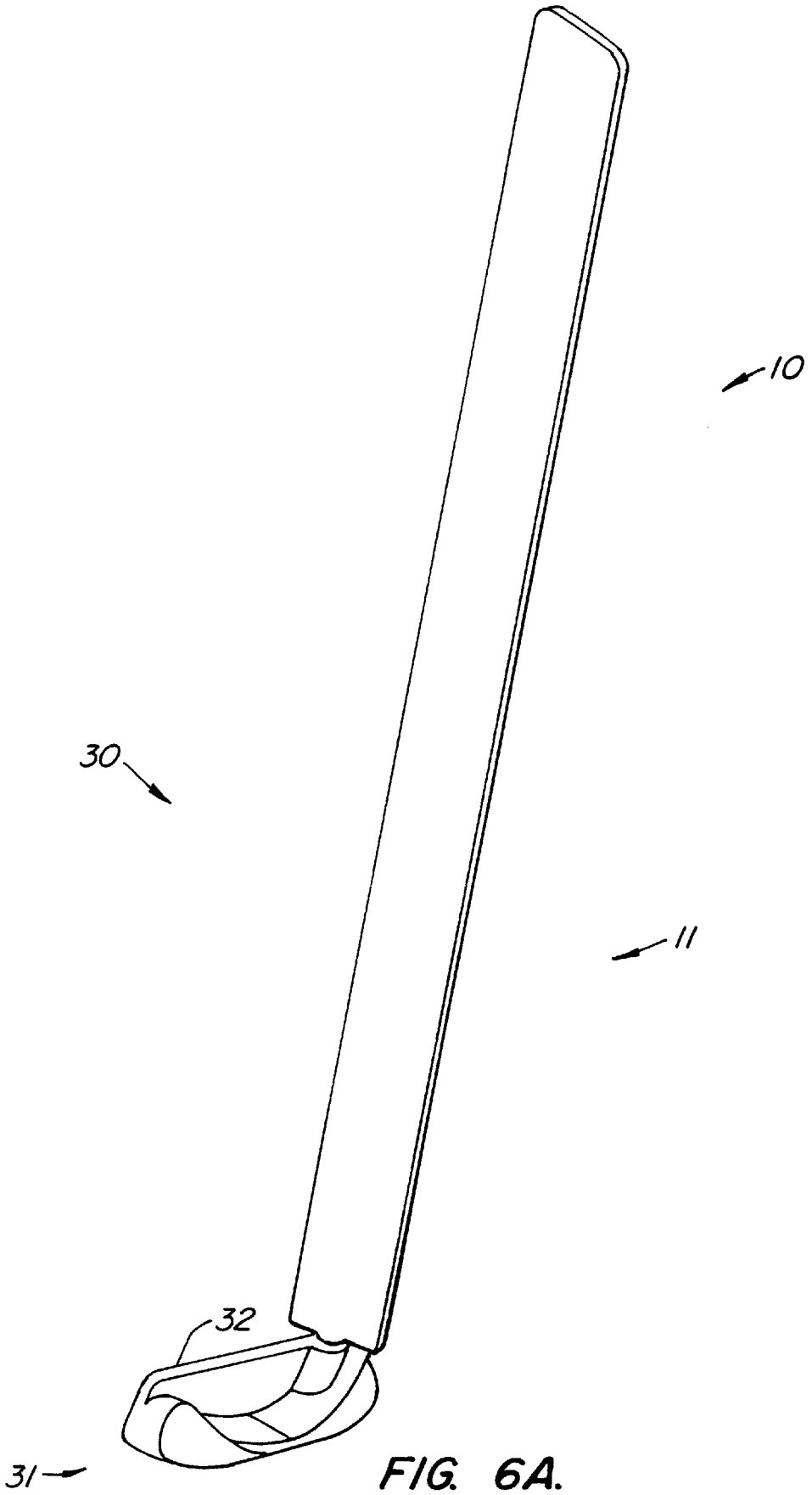
FIG. 6A is a perspective view of a putter that includes a grip in accordance with an alternative embodiment of the present invention.
Figure 6B:
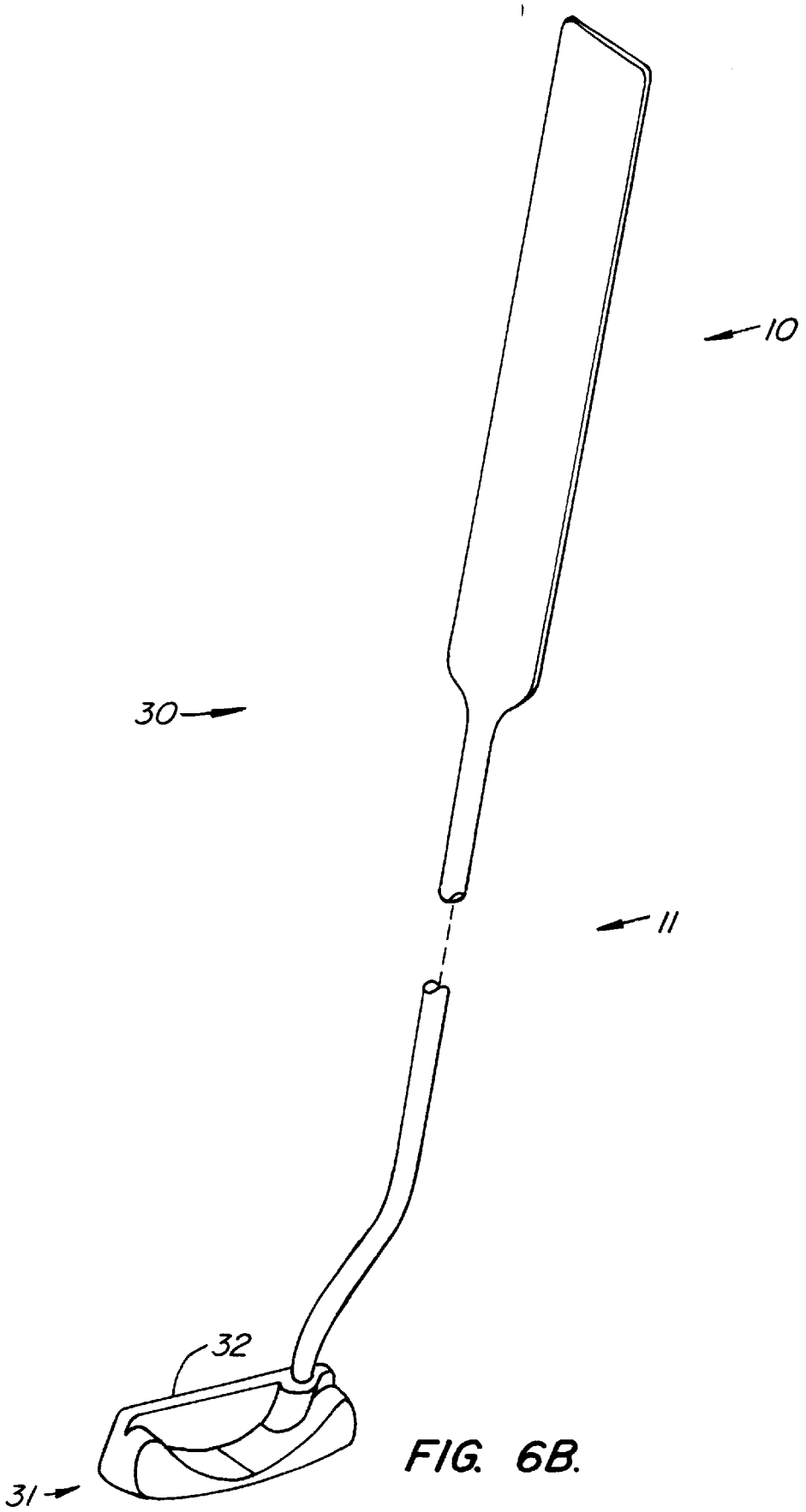
FIG. 6B is a perspective view of a golf putter that includes a grip in accordance with another alternative embodiment of the present invention.

As can be seen in FIG. 1A, grip 10 includes a recess 20 that receives shaft 11, thus connecting grip 10 to shaft 11. Grip 10 may extend over as long a portion of the shaft as may be desired. Of course, grip 10 can extend along the entire length of the shaft, thereby forming the shaft, if it is so desired, such that grip 10 is integral with the shaft as illustrated in FIGS. 6A and 6B. In such a configuration, the integrated grip/shaft may extend in the substantially rectangular shape, such as is illustrated in FIG. 6A, or may have a tapered shape wherein the integrated grip/shaft is narrower adjacent the club head of the club and wider at a distal portion such that the distal portion has a shape corresponding to that which is illustrated in FIG. 1A for gripping by a golfer.

Figure 1C:
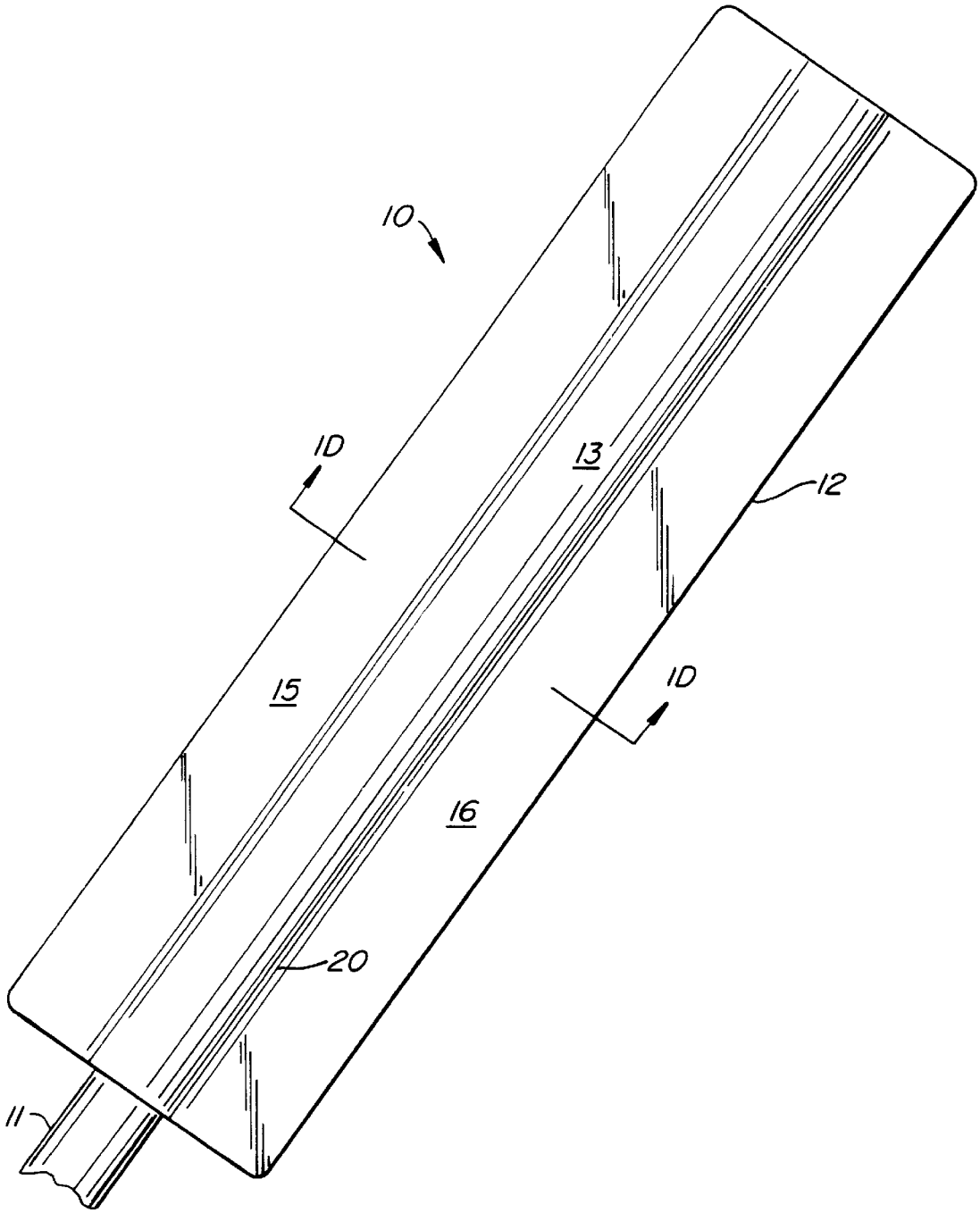
FIG. 1C is a plan view of an alternative embodiment of a grip in accordance with the present invention.
Figure 1D:
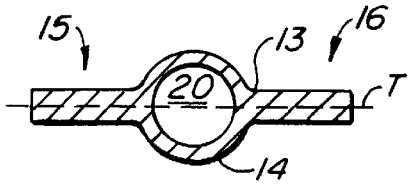
FIG. 1D is a cross-sectional view of the alterative embodiment of the grip illustrated in FIG. 1C.

As can be seen in FIG. 1C, recess 20 may extend along the entire length of grip 10. In such an embodiment, front side 13 and back side 14 are substantially flat at right portion 15 and left portion 16, as is clearly seen in FIG. 1D.

Recess 20 is preferably configured to fit over current, standard putter shafts. Most putters currently have round rubber or leather grips. These round grips may be removed and replaced with a grip 10 in accordance with the present invention by placing shaft 11 within recess 20. Alternatively, when a putter is being manufactured, a grip 10 in accordance with the present invention may be placed on the putter shaft by placing shaft 11 within recess 20 during the putter manufacturing process.

Figure 5:
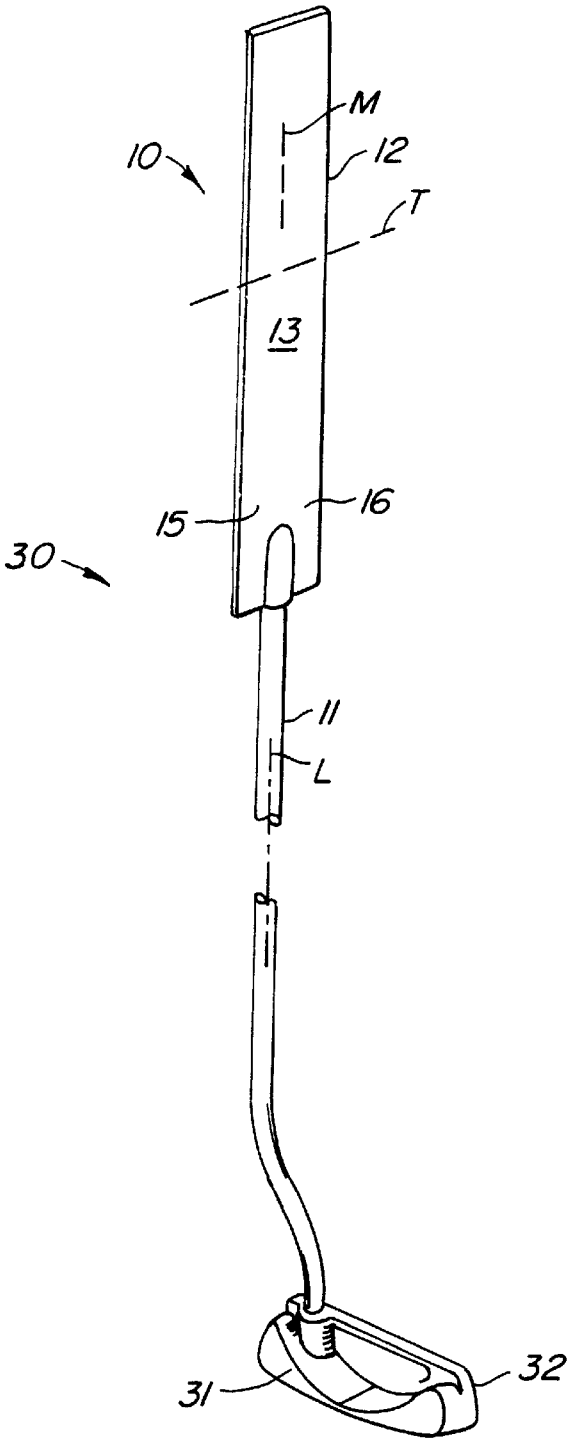
FIG. 5 is a perspective view of a putter, including a putter grip, in accordance with the present invention.

FIG. 5 illustrates a grip 10 with a putter 30. Putter 30 includes shaft 11 and club head 31. Club head 31 includes club face 32.

The transverse axis T is substantially perpendicular to the longitudinal axis L and major axis M. Likewise, the transverse axis T is substantially transverse to the club face 32 of the club head 31. Such a configuration provides for substantial stiffness within the grip, and thereby the club, with respect to the motion of swinging the club in order to strike a ball.

Figure 2:
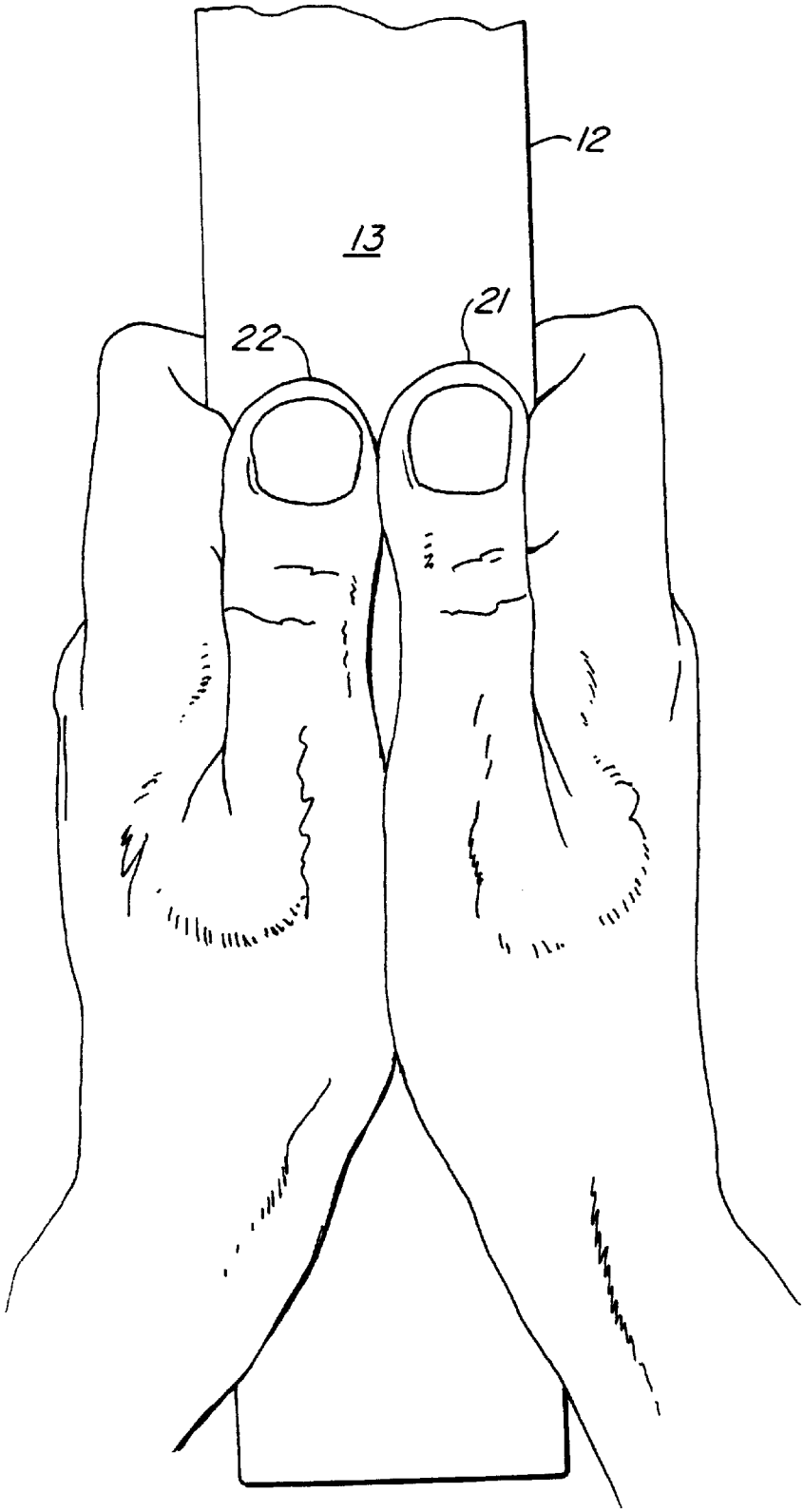
FIG. 2 is a plan view of a golfer's hands gripping a grip in accordance with the present invention.
Figure 3:
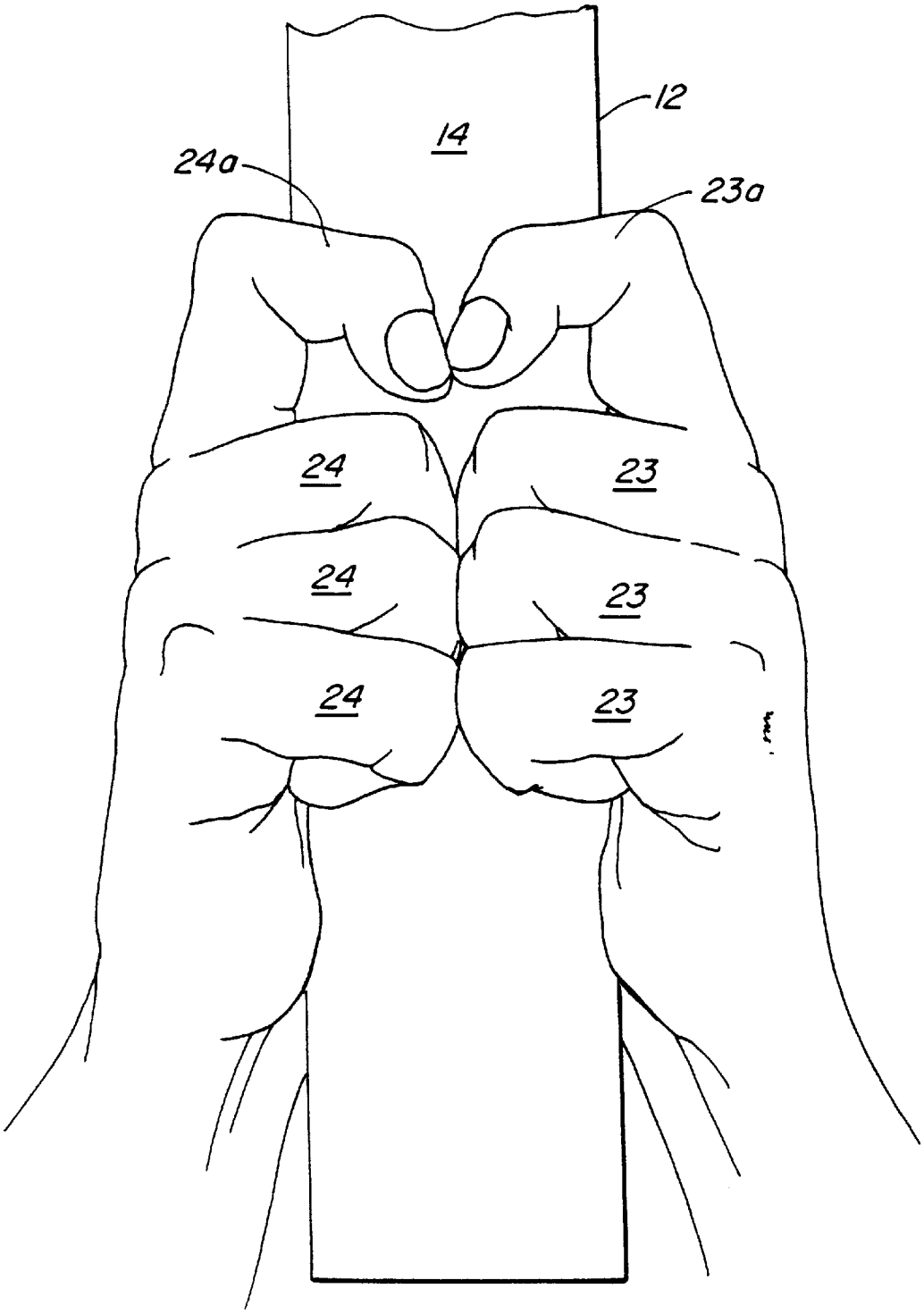
FIG. 3 is a bottom elevation view of a golfer's hands gripping a grip in accordance with the present invention.

Turning to FIGS. 2–4A, a method of gripping grip 10 is illustrated. A golfer places his right thumb 21 adjacent his left thumb 22 on the front side 13 of the grip 10 as can be seen in FIG. 2. As can be seen in FIG. 3, the golfer curls his right fingers 23 adjacent his left fingers 24 along back side 14 of grip 10. Preferably, all of the right fingers 23 and left fingers 24 are curled along back side 14. However, the golfer may, depending upon comfort and preference, only curl one, two or three of his fingers. Additionally, index fingers 23A, 24A may have varying degrees of curling, and indeed, may even be extended longitudinally in a substantially straightened manner along grip 10 if so desired.

Figure 4A:
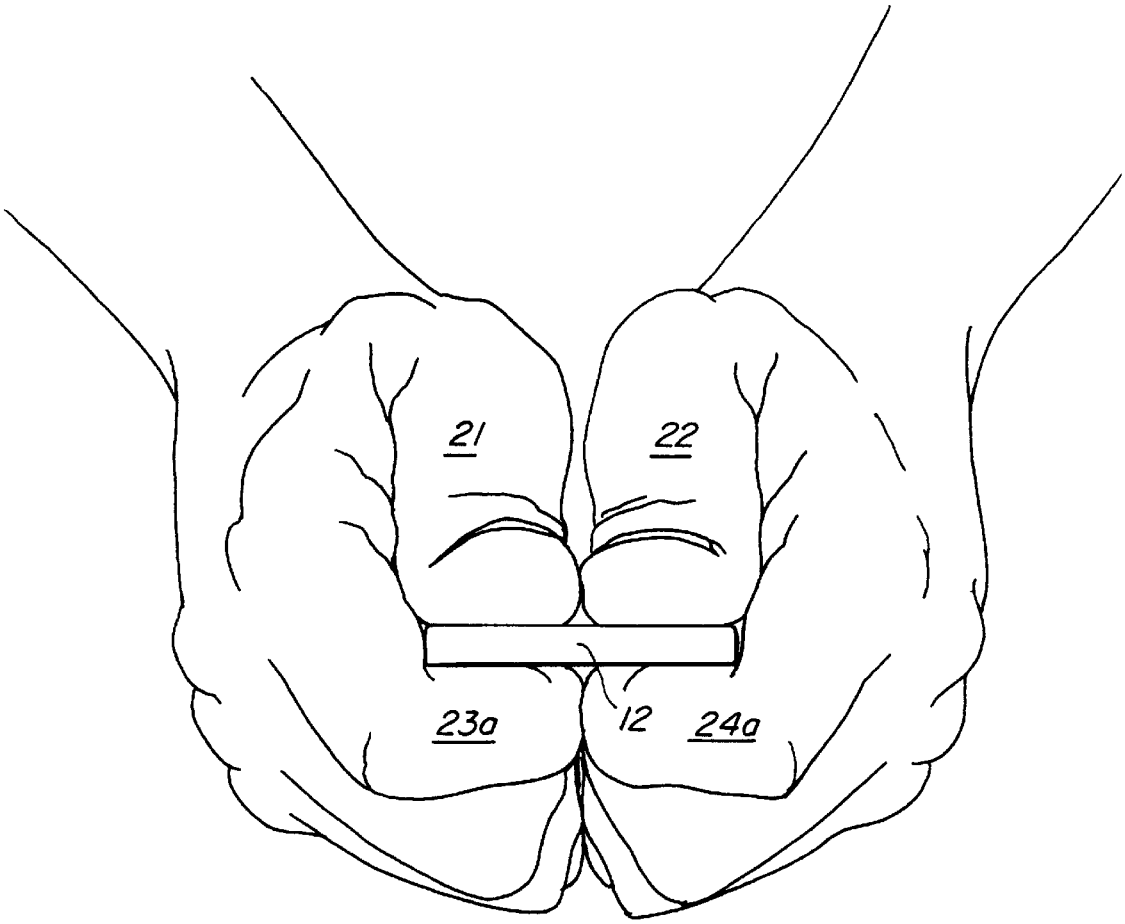
FIG. 4A is a bottom elevation view of a golfer's hands gripping a grip in accordance with the present invention.
Figure 4B:
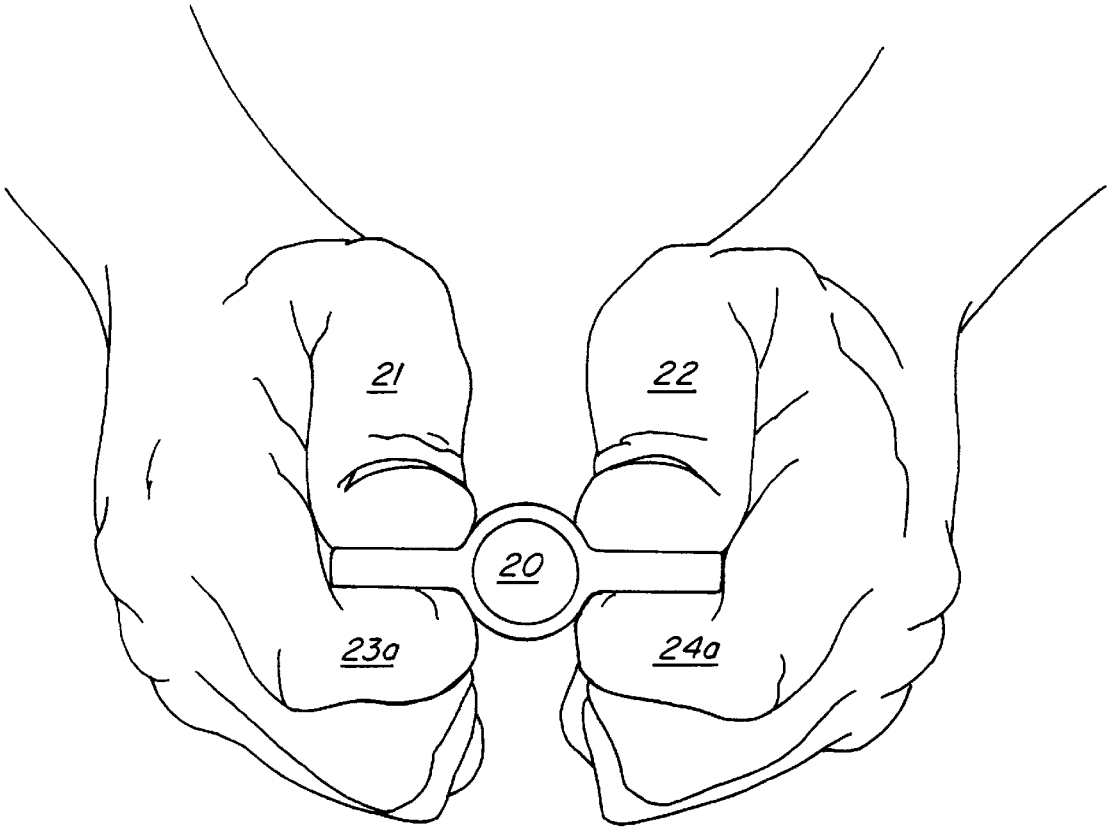
FIG. 4B is a bottom elevation view of a golfer's hands gripping the alternative embodiment of the grip illustrated in FIGS. 1C and 1D.

FIG. 4B illustrates a golfer gripping the embodiment of the grip 10 wherein recess 20 extends along the entire length of body 12.

A representative dimension of grip 10 when used with a putter, under current R & A standards and rules, is 1.75 inches for the maximum transverse axis T. As the current R & A standards and rules indicate in Appendix A, a putter grip may have a non-circular cross-section, provided the cross-section has no concavity, is symmetrical, and remains generally similar throughout the length of the grip. The grip may be tapered but must not have any bulge or waste. Its cross-sectional dimension measured in any direction must not exceed 1.75 inches (45 mm).

Accordingly, the present invention provides a grip for a club, and in particular, a golf putter, that improves the pendulum swing desired during the putting stroke. This is generally due to the fact that the placement of the hands of the golfer is outside of the shaft's axis, i.e., the golfer's hands preferably do not interlock or have overlapping fingers, thereby putting the axis of the shaft in between the hands as opposed to the hands surrounding the shaft and thereby the shaft axis. This significantly reduces any rotation effect of the shaft. Additionally, the golfer feels the putter head at the opposing end of the putter since only the fingers are in contact with the grip and fingers are generally more sensitive than the palm of one's hand.

As stated previously, the flatness of the grip is generally transverse or perpendicular to the face of the club head and thus parallel to the line of the putt. This unique feature allows the golfer to maintain his swing plane or swing path. This provides the golfer with confidence in his perception of the putting line and minimizes the importance of the hole position in relation to the putting line. Thus, the golfer can trust perceptions that are not purely visual.

Finally, the relatively small volume of the putter grip ensures a "strong" grip with only the use of the fingers. This strong grip, associated with the symmetry of the hands, makes the wrists naturally passive. With the wrists naturally passive, and the fact that the fingers alone are unable to produce a swing, encourages the golfer to initiate the swing with his arms, or better, with his shoulders, as opposed to initiating the swing with his hands and wrists.

Although the invention is being described with reference to specific exemplary embodiments, it will be appreciated that it is intended to cover all modifications and equivalents within the scope of the appended claims.

What is claimed is:

1. A method of gripping a grip, the method comprising:

providing a club comprising:

a shaft defining a longitudinal axis;

a club head including a club face and being connected to a distal end of the shaft, the shaft defining an obtuse angle with respect to the club head;

a grip connected to a proximal end of the shaft, the grip comprising an elongated body that extends along a major axis corresponding to the longitudinal axis defined by the shaft, the body including a front side, an opposing back side, a right portion and a left portion, the front side and the back side being substantially flat at the right portion and at the left portion, the body defining an elongated cross-section that extends along a traverse axis that is substantially perpendicular to the longitudinal axis and traverse to the club face;

placing thumbs of a user on the front side of the grip and to either side of the longitudinal axis;

placing at least one finger of a right hand of a user on the back side of the grip to one side of the longitudinal axis and at least one finger of a left hand of the user on the back side of the grip to another side of the longitudinal axis; and curling the at least one finger of the right hand of the user toward the right hand along the back side of the grip and curling the at least one finger of the left hand of the user toward the left hand along the back side of the grip.

2. The method of claim 1 wherein at least two fingers of the right hand of the user are placed on the back side of the grip to one side of the longitudinal axis and at least two fingers of the left hand of the user are placed on the back side of the grip to another side of the longitudinal axis, and wherein the at least two fingers of the right hand of the user are curled toward the right hand along the back side of the grip and the at least two fingers of the left hand of the user are curled toward the left hand along the back side of the grip.

3. The method of claim 2 wherein at least three fingers of the right hand of the user are placed on the back side of the grip to one side of the longitudinal axis and at least three fingers of the left hand of the user are placed on the back side of the grip to another side of the longitudinal axis, and wherein the at least three fingers of the right hand of the user are curled toward the right hand along the back side of the grip and the at least three fingers of the left hand of the user are curled toward the left hand along the back side of the grip.

4. The method of claim 3 wherein at least four fingers of the right hand of the user are placed on the back side of the grip to one side of the longitudinal axis and at least four fingers of the left hand of the user are placed on the back side of the grip to another side of the longitudinal axis, and wherein the at least four fingers of the right hand of the user are curled toward the right hand along the back side of the grip and the at least four fingers of the left hand of the user are curled toward the left hand along the back side of the grip.

5. A club comprising:

a club head including a club face;

a shaft coupled to the club head, the shaft defining a longitudinal axis and including a head coupling portion for coupling the shaft to the club head at a distal end of the shaft, the shaft defining an obtuse angle with respect to the club head; and a grip connected to a proximal end of the shaft, the grip comprising an elongated body that extends along a major axis corresponding to the longitudinal axis defined by the shaft, the body including a front side, an opposing back side, a right portion and a left portion, the front side and the back side being substantially flat at the right portion and at the left portion, the body defining an elongated cross-section that extends along a transverse axis that is substantially perpendicular to the longitudinal axis and transverse to the club face;

wherein at at least the right and left portions, a distance between the front side and the back side is smaller than a parallel distance defined by the head coupling portion.

6. The club of claim 5 wherein the grip further comprises a recess for receiving the shaft to thereby connect the grip to the shaft.

7. The club of claim 5 wherein the recess extends substantially throughout the body between the right portion and the left portion.

8. The club of claim 5 wherein the grip is integral with the shaft.

9. The club of claim 5 wherein the grip includes rounded edges.

10. The club of claim 5 wherein the grip includes sharp edges.

* * * * *